US006210514B1

(12) United States Patent
Cheung et al.

(10) Patent No.: US 6,210,514 B1
(45) Date of Patent: Apr. 3, 2001

(54) THIN FILM STRUCTURE MACHINING AND ATTACHMENT

(75) Inventors: Patrick C. P. Cheung, Castro Valley; Andrew A. Berlin, San Jose; David K. Biegelsen, Portola Valley; Rachel King-Ha Lau, Fremont; Mark H. Yim, Palo Alto, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/022,173

(22) Filed: Feb. 11, 1998

(51) Int. Cl.[7] ..... B32B 31/18

(52) U.S. Cl. ..... 156/241; 156/230; 156/233; 156/247; 156/250; 156/256; 156/267

(58) Field of Search ..... 156/230, 233, 156/239, 241, 247, 248, 249, 256, 250, 267

(56) References Cited

U.S. PATENT DOCUMENTS 4,016,665 * 4/1977 Sakota .
4,985,274 * 1/1991 Wright .
5,252,169 * 10/1993 Bechmann .
5,338,615 * 8/1994 Quick et al. ..... 156/233 X

* cited by examiner

*Primary Examiner*—Curtis Mayes
(74) *Attorney, Agent, or Firm*—Oliff & Berridge, PLC

(57) ABSTRACT

Batch fabrication of thin film structures can be facilitated by sandwiching a thin film between a first and a second polymeric or elastomeric layers. The sandwiched layer can be machined to define a thin film structure, typically a micoroelectromechanical element. This element is separated from the sandwiching layers by adhesive attachment to a target substrate.

12 Claims, 14 Drawing Sheets

THIN FILM STRUCTURE MACHINING AND ATTACHMENT

FIELD OF THE INVENTION

The present invention relates to production of thin film structures suitable for use in microelectromechanical or microelectronic devices. More particularly, the present invention relates to thin film structures carried by low tack polymeric membranes.

BACKGROUND AND SUMMARY OF THE INVENTION

Construction of microelectromechanical or microelectronic devices often requires moving a delicate thin film structure created on a source substrate to a new position on a target substrate, with the source substrate being permanently separated from contact with the thin film structure. Various lift procedures based on low tack adhesives or electrostatic forces have been developed to allow conveyance of thin film structures between different substrates. For example, thin metallic leads carried on adhesive tape are often used for production of semiconductor devices in various tape bonding processes.

Unfortunately, the stressful process of separating the thin film structure from adhesive attachment to a source substrate can deform, alter, or misposition the thin film structure. While this deformation is inconsequential for relatively large and thick electrical contacts, even slight deformation or mispositioning of moving or non-moving elements in complex microelectromechanical devices can result in device failure. For example, micromechanical fluid valves composed of thin, movable metallic or polymeric structures are particularly susceptible to curling deformations induced during the separation process. When arrays of such valves are produced and assembled, even failure of a handful of valves due to deformation destroys or greatly diminishes utility of the entire valve array assembly.

The present invention alleviates some of the problems associated with the foregoing methods for transferring thin film structures by providing a low stress transfer method based on use of non-adhesive polymeric membranes. In the method of the present invention, a thin film is affixed to a low tack polymeric membrane. While positioned on the polymeric membrane, the thin film is machined to define a thin film structure. This thin film structure (or array of thin film structures) is then separated from the polymeric membrane in a substantially deformation free state. In this manner, various target substrates, including glass, silicon, or printed circuit boards, can be equipped with substantially stress free thin film structures suitable for use in a wide variety of microelectromechanical or microelectronic devices.

The polymeric membrane can be formed from various chemically inert polymeric materials. For best results, low tack elastomeric membranes formed from polysiloxanes, polyurethanes, urethanes, styrenes, olefinics, copolyesters, polyamides, or other melt processible rubbers can be used. For example, a room temperature vulcanizable polysiloxane such as Sylgard 184, manufactured by Dow Corning Corp., can be used. Suitable membranes are also available from Vichem Corporation, Sunnyvale, Calif., under the trade name GEL-PAK™.

For sufficiently small pieces, the polymeric membrane can be unsupported. For use in conjunction with larger pieces or large batch fabricated arrays of microstructures, the optional use of a support layer capable of rigidly or flexibly supporting the polymeric membrane is preferred. For example, glass, sapphire, or epoxy impregnated fiberglass laminates such as used in conventional printed circuit boards can be formed as a suitable rigid support layer, while various polymeric materials such as polyesters, polyamides, polyimides, polyolefins, polyketones, polycarbonates, polyetherimides, fluoropolymers, polystyrene, or polyvinyl chloride can also optionally be used as either a rigid or flexible membrane support layer.

Advantageously, both the polymeric membrane and any optional membrane support layer can be selected to be transparent or substantially transparent. Transparency allows a user to optically guide movement of thin film structure supported on a source substrate into an appropriate position with respect to a target substrate. In addition, optical transparency simplifies use of laser cutting or etching techniques and allows for quality control inspections of both sides of the thin film structures prior to mating with the target substrate. In one particularly useful embodiment, thin film structures defined on a metallized polymeric film sandwiched between two polymeric membranes can be machined by lasers that transfer energy to cut the metallized polymeric film without transferring energy to cut the sandwiching transparent polymeric membranes.

As will be appreciated, in addition to lasers, various mechanical, electrical, chemical, acoustic, or optical techniques can be used to machine, define or modify structures in the thin film layer. For example, mechanical techniques can include stamping, die cutting, kiss cutting, shearing, punching, blanking, forming, bending, forging, coining, upsetting, flanging, squeezing, and hammering using presses with a movable ram that can be pressed against the supported thin film layer. Electrical techniques can include electrical discharge machining using high frequency electric sparks. Chemical techniques are commonly employed in conjunction with electrical or mechanical techniques, and can include chemical/mechanical polishing, electrochemical machining using controlled dissolution of metals, electrolytic grinding, electrochemical arc machining using controlled arcs in an aqueous material to remove thin film material, and acid electrolyte capillary drilling. Acoustic techniques such as ultrasonic machining using abrasives, or ultrasonic twist drilling are also suitable for shaping the thin film, as are optical techniques such laser cutting and drilling or various patterning techniques using photochemical resist etching. In certain embodiments, high pressure fluid drilling or cutting (with or without entrained abrasives) can even be used.

As will be appreciated, the present invention has particular utility in conjunction with applications requiring the use of sensitive and fragile thin films (organic, inorganic, or composite films). Unlike their bulk counterparts, thin films are extremely sensitive to applied stress. Particular areas of concern in the handling and processing of thin films include wrinkling, creasing, scratches, contamination, and residual/surface stresses. The first issue is handling damage. For example, when dealing with metallized polymers (like the 0.005" aluminized polyesters), rolls of the material are preferred to reduce any manual handling of the thin film. Any creasing, wrinkling or folding of the thin film may permanently damage the film. However, before proceeding onto the actual fabrication steps utilizing a thin film, it must generally be mounted or otherwise held down. Lamination of the thin film onto sheets of conventional transfer mats (e.g. an adhesive acrylic/paper composite used in die cut and stamping operations) results in stress and deformation of the film upon removal. The accumulation of residual stress results in catastrophic deformation to the thin film samples. Upon release from the transfer mat, the thin film structures curl up upon itself in an attempt to minimize surface energy.

However, use of the method of the present invention advantageously results in minimal induced stresses upon release of the completed thin film structures, allowing safe transfer and handling of even large thin film sheets, thin film structures, or arrays of thin film structures. Use of a polymeric or elastomeric material in accordance with the present invention also simplifies machining and fabricating processes when used as a sacrificial layer, and can facilitate optical alignment methods during transfer and attachment processes. Additionally, the use of electrically conductive adhesives permit thermoset and thermoplastic heat reactions for bonding thin film structures to the target substrate, widening material choices that accommodate thermal budgets of a device, and even providing the ability to reposition or rework an attached thin film structure by reheating the thermoplastic adhesive on the target substrate.

Given the foregoing advantages, those skilled in the art will appreciate that while useful for production of electrical contacts, pads, leads, transistor elements, dielectric caps, or other conventional microelectronic elements, thin film structures produced in accordance with the present invention are particularly valuable for use in microelectromechanical systems (MEMS). Example MEMS devices can include microoptical systems such as lenses, waveguides, diffraction gratings, semiconductor laser arrays, or light detectors. Other MEMS devices can include microactuators, mechanical filter systems, acoustic or vibration sensors based on cantilevered structures, thermal sensors, or even arrays of electrically actuated valves, such as represented by electrostatic or electromagnetic flap valves used for fluid control. The present invention has particular utility for production of movable elements (or support structures for movable elements) sized on the order of microns to millimeters.

Additional functions, objects, advantages, and features of the present invention will become apparent from consideration of the following description and figures of preferred embodiments.

DETAILED DESCRIPTION OF THE INVENTION

Figure 1:
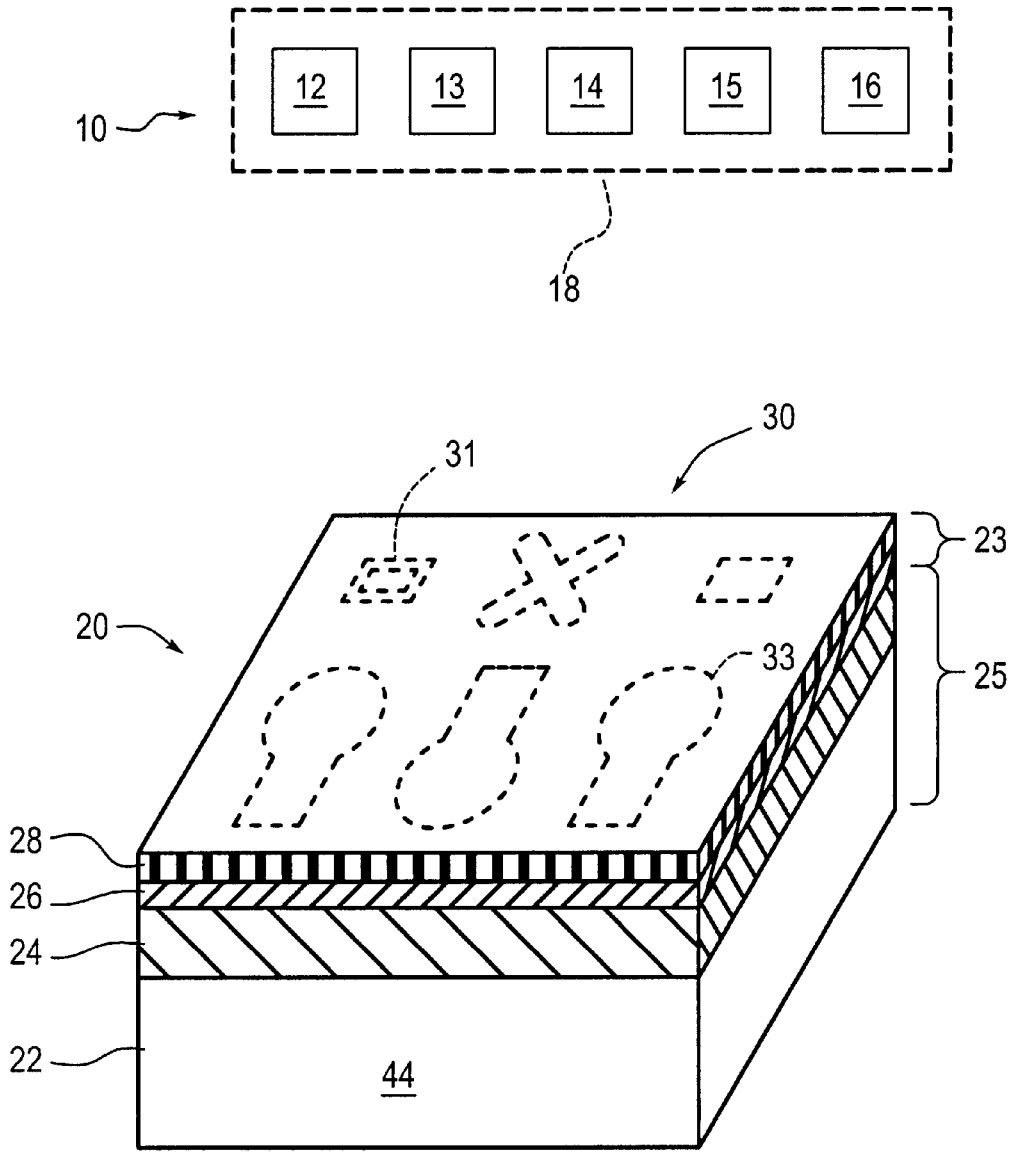
FIG. 1 is a schematic view of an aluminized polyester thin film lightly held by a low tack polymeric membrane prior to machining along a prospective cut line indicated by the dotted line.

FIGS. 1 through 4 schematically illustrate practice of one embodiment of the present invention. FIG. 1 shows a not to scale schematic view of a thin film machining assembly 10 that includes a machining unit 18 for cutting, polishing, working, or otherwise modifying a supported thin film assembly 20.

The machining unit 18 optionally includes one or more cutting/working devices such as optical modification unit 12, mechanical modification unit 13, electrical modification unit 14, chemical modification unit 15, or acoustic modification unit 16. These units 12–16 can be used alone or in combination with each other, or in combination with other conventional material machining techniques, to machine, cut, polish, work, define or otherwise modify thin films of the thin film assembly 20. For example, the optical modification unit 12 can include infrared, optical, or ultraviolet lasers for laser cutting thin films, or an intense non-coherent light source for use in conjunction with various known photochemical etching techniques. The mechanical modification unit 13 can include tooling for polishing, stamp cutting, die cutting, kiss cutting, shearing, punching, blanking, forming, bending, forging, coining, upsetting, flanging, squeezing, and hammering using presses with a movable ram that can be pressed against the supported thin film assembly 20, and even high pressure fluid cutting techniques. The electrical modification unit 14 can include electrical discharge machining using high frequency electric sparks, while the chemical modification unit 15 can include photochemical etching (in conjunction with optical modification unit 12) chemical/mechanical polishing (in conjunction with mechanical modification unit), electrochemical machining using controlled dissolution of metals, electrolytic grinding, electrochemical arc machining using controlled arcs in an aqueous material to remove thin film material, and acid electrolyte capillary drilling. In certain embodiments, an acoustic modification unit 16 that permits ultrasonic machining using abrasives, or ultrasonic twist drilling, are also suitable for modifying the thin film. As those skilled in the art will appreciate, other suitable thin film modification techniques, including those not based on various optical, mechanical, electrical, chemical, or acoustic techniques, can also be used as required.

As seen with respect to FIG. 1, the machining unit 18 is directed to modify a supported thin film assembly 20 held by a carrier 44. The carrier 44 can be any conventional mechanical, electromagnetic, or fluid support for holding or conveying the thin film assembly. For example, the carrier 44 can be a rigid glass substrate, a metal plate holder, a fluid air bed, or even a robotically operated arm. As will be appreciated, the carrier can merely provide a support (e.g. when laser cutting techniques are employed), or can optionally form a part of the machining unit 18 (e.g. by acting as an electrode in various electrochemical machining techniques).

The thin film assembly 20 held by carrier 44 includes a thin film support 25 for holding thin films 24. Usually, the thin film support 25 includes a support layer 22 capable of rigidly or flexibly supporting a non-adhesive polymeric membrane 24 place in direct contact with thin films. The polymeric membrane 24 can be formed from various chemically inert polymeric materials, and may be used in crosslinked or gel form. In certain embodiments, use of substantially transparent membranes is preferred. For best results, low tack elastomeric membranes formed from polysiloxanes, polyurethanes, urethanes, styrenes, olefinics, copolyesters, polyamides, or other melt processible rubbers can be used. For example, a room temperature vulcanizable polysiloxane such as Sylgard 184, manufactured by Dow Corning Corp., can be used. Suitable membranes are also available from Vichem Corporation, Sunnyvale, Calif., under the trade name GEL-PAK™. Good results have been obtained by use of GEL-PAK part number BP-70-X0, which is a polyester supported elastomer having very low tackiness and retention. For best results, polymeric membranes having a hardness of less than 70 on the Shore A durometer scale can be used, with very soft membranes having a hardness of less than 20 being preferred. Other suitable materials for a polymeric membrane 24 are described in U.S. Pat. No. 5,682,731, assigned to Vichem Corporation, the disclosure of which is herein specifically incorporated by reference.

Any suitable substrate material can be used to form support layer 22 for optionally holding the polymeric membrane 24. For example, glass, sapphire, or epoxy impregnated fiberglass laminates such as used in conventional printed circuit boards can be formed as a suitable rigid support layer, while various polymeric materials such as polyesters, polyamides, polyimides, polyolefins, polyketones, polycarbonates, polyetherimides, fluoropolymers, polystyrene, or polyvinyl chloride can also optionally be used as either a rigid or flexible membrane support layer. For certain embodiments, use of a substantially transparent support layer is preferred. For example, an optically transparent 5 mil (0.005 inch) polyester film (e.g. Mylar™) can be used as a flexible membrane support layer that allows for peeling separation of the polymeric membrane from the thin film structure. Alternatively, a 0.5 inch transparent polycarbonate supporting an affixed polymeric membrane can be used as a temporary holder of thin film structures for certain embodiments requiring greater dimensional stability. In certain embodiments, selection of a transparent or at least partially transparent support layer 22, in conjunction with a transparent or partially transparent polymeric membrane 24, permits optical inspection and use of optical alignment techniques during assembly of devices incorporating thin film structures.

As seen in FIG. 1, multiple thin films 23 can be supported by the thin film support 25. In the illustrated embodiment of FIG. 1, a polyester layer 26 having a thickness on the order of 10 microns supports an aluminum layer 28 having a thickness on the order of 0.1 microns. As will be appreciated, in addition to polyester or aluminum thin films, films based on other polymers, including organic polymers such as polyethylene, polystyrene, polyamides, polyimides, can be used. In certain applications, inorganic polymers such as silanes or silicones can be used. Of particular utility for microelectronic and microelectromechanical devices are glass or polycrystalline films, silica wafers, or other crystalline materials commonly used in the semiconductor processing industry. Conductive metal films such as chromium, copper, tin, or gold can be used, as can various non-conducting dielectric films such as indium tin oxide. Other films may be durable coatings of titanium nitride or diamond.

Films can be formed by direct deposit of individual molecules on the polymeric membrane 24, by deposition of large numbers of particles or liquid through traditional thick film technologies such as silk screening, spin coatings, or painting, by contact transfer of film from a separate liquid or solid support to the thin film support 25, or by any other conventional deposition or transfer technique. As will be appreciated, films do not have to be homogeneous materials, but can be heterogeneously patterned, have structured compositions or be formed to have superlattices. Multilayer or structured layers are also contemplated to be within the scope of the present invention. Generally, films are on the order of 0.1 microns to 100 microns in thickness, but certain films (e.g. carbon deposited by pyrolysis, or extruded plastic sheets) can be as thick as 1 millimeter.

As seen in FIG. 1, complex shaped thin film structures 30 (indicated in outline, for example as element 31 and element 33) can be defined for machining from the thin films 24. Such structures (or arrays of structures) can be useful in conjunction with microelectronic or microelectromechanical devices, or can be used for their optical, electrical, magnetic, chemical, mechanical, or thermal properties. Such uses may include, but are not limited to, microoptical elements such as lenses or wave guides, mirrors, reflective and anti-reflective coatings, interference filters, or diffraction gratings. Electrical elements constructed from thin film structures can include insulative lines or plates, conductive lines or pads, semiconductor device elements, photodetectors, or photoemitters. Magnetic film structures can be used as memory storage elements, while thermal elements can be used as microthermal barriers, heat sinks, or thermal detectors. Thin film structures can be used as wear resistant coatings, chemical barriers, diffusion barriers, corrosion barriers, or even as substrates for chemical or biological sensors.

Figure 2:
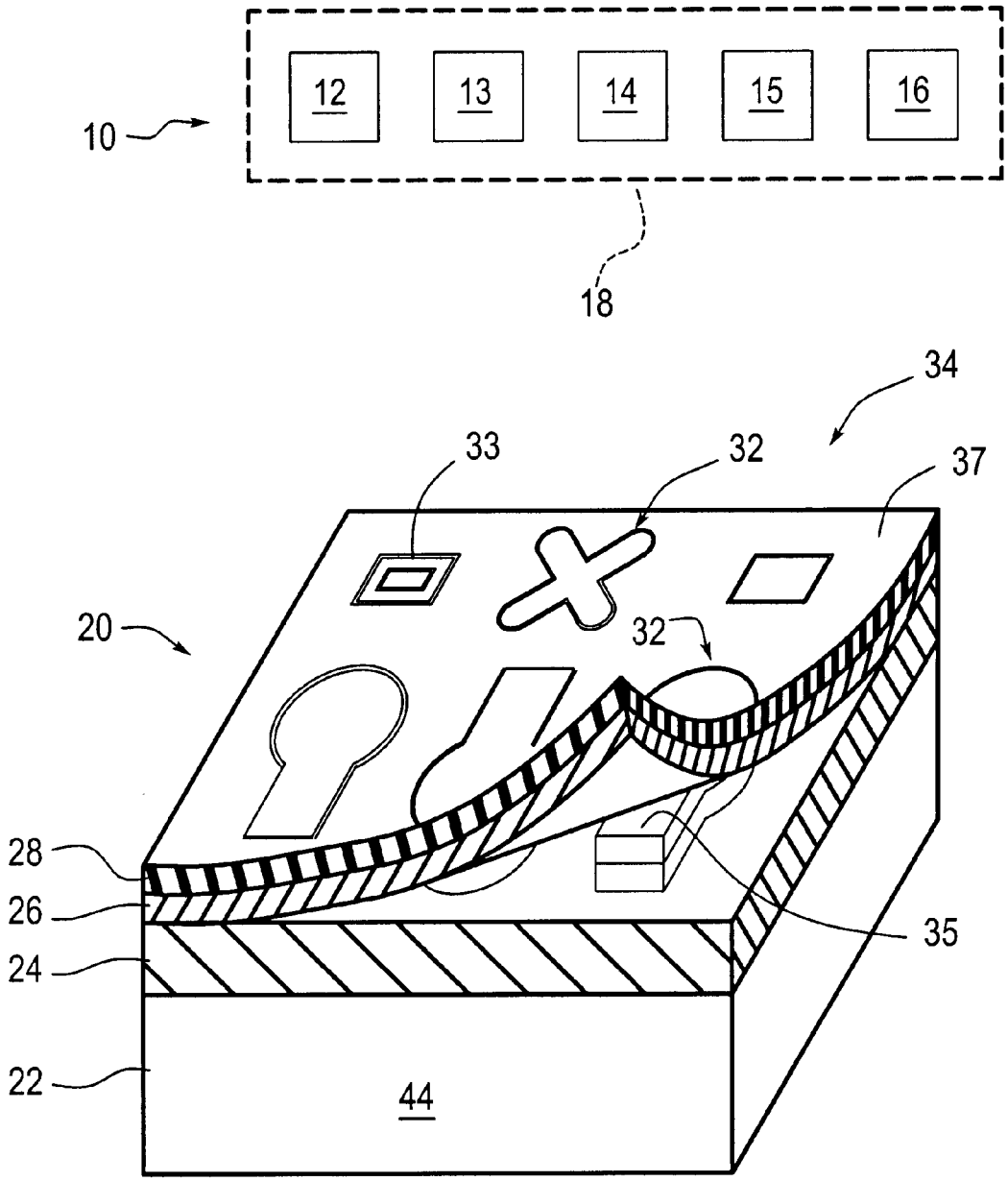
FIG. 2 is a schematic view of a thin film structure (i.e. a portion of an electrostatic flap valve array) machine cut from the aluminized polyester thin film of FIG. 1, with the residual aluminized polyester thin film being peeled away from the low tack polymeric membrane.
Figure 3:
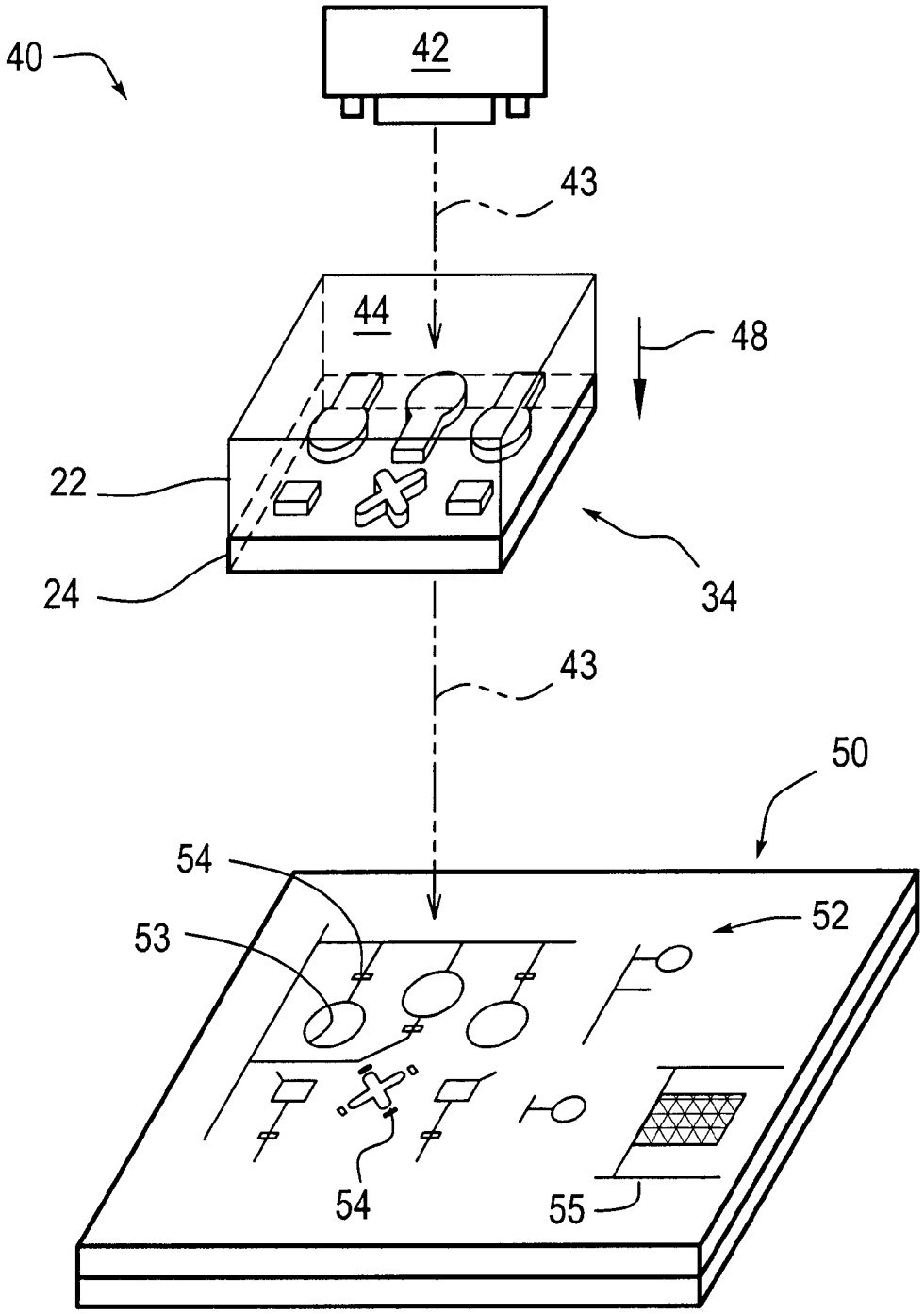
FIG. 3 is a schematic view of the thin film structure of FIG. 2 being transferred to a target substrate, with optical transparency of the polymeric membrane allowing accurate positioning of the thin film structure on the target substrate.
Figure 4:
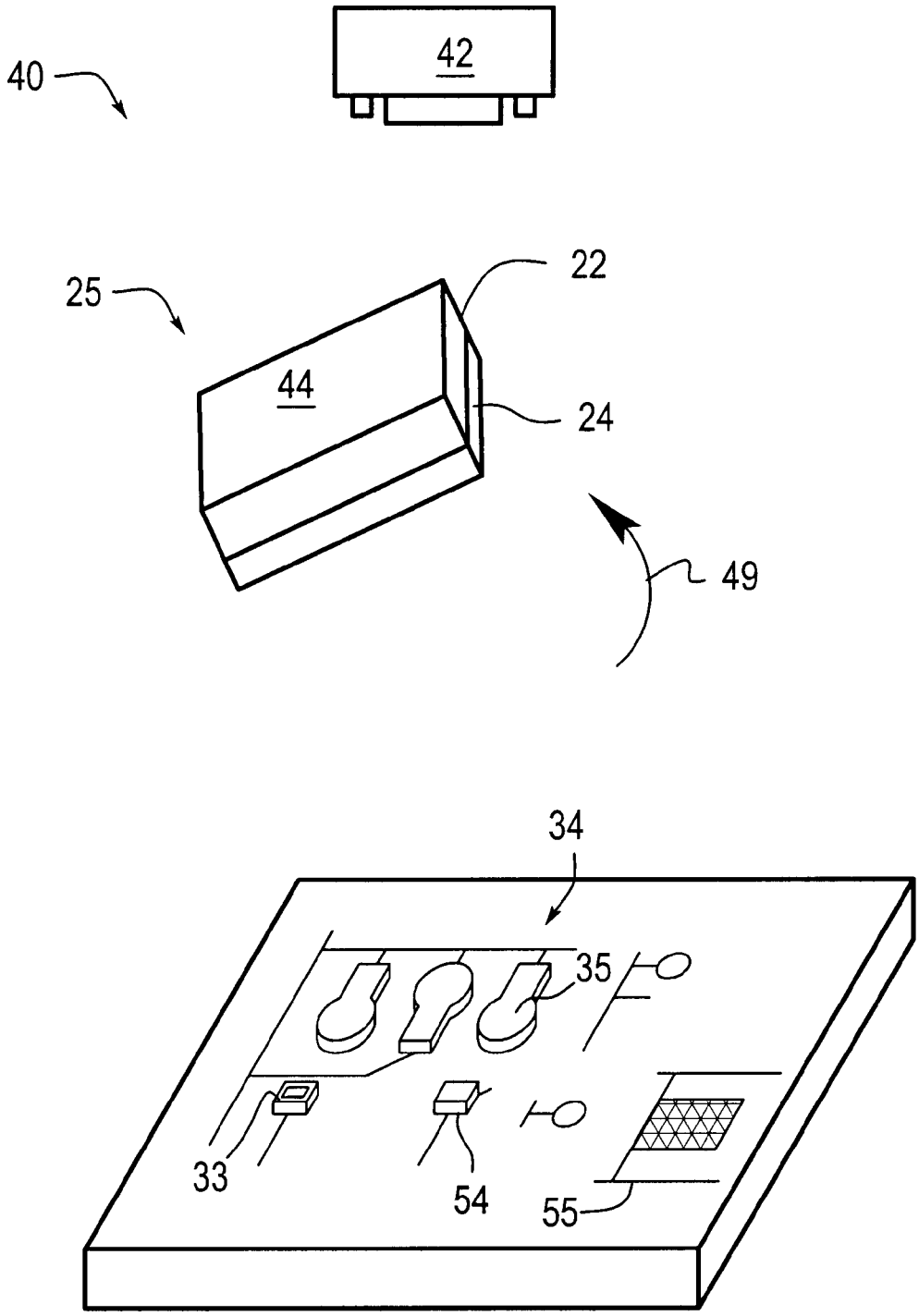
FIG. 4 is a schematic view of the thin film structure of FIG. 3 bonded in place on the target substrate, with the polymeric membrane pulled away to leave the thin film structure in a substantially stress free state on the target substrate.

Operation of the present invention is best seen in conjunction with FIGS. 2, 3, and 4. As seen in FIG. 2, the optical modification unit 12 of the machining unit 18 is used to cut (by localized heating and evaporation) the thin films 24 supported by the polymeric membrane 24. A laser is directed so that cut lines 32 match the predefined lines 30 of FIG. 1, forming disjoint complex shapes 34 as a positive ground (i.e. the thin film structures 33 and 35) and leaving the bulk of the thin film as a substantially connected negative ground 37. As seen with respect to thin film structure 33, even structures having holes or apertures therein can be defined. Alternatively, selective etching, drilling, or laser cutting can be used to thin, groove, or mark the complex shapes 34.

After cutting the shapes 34, the negative ground 37 of the thin film 24 is peeled or lifted away from contact with the polymeric membrane 24, leaving the positive ground of shapes 34 remaining behind in undisturbed contact with the polymeric membrane 24. As those skilled in the art will appreciate, the liftoff procedure can be reversed, with the individual shapes 34 separately lifted to leave complex shaped apertures in negative ground 37 of thin films 24. Such negative ground structures can be employed, for example, in forming large connected passive array lines for electromagnetically or electrostatically controlled microelectromechanical structures such as fluid valves, light valves, or the like.

Optically guided assembly is seen in FIG. 3, which shows the carrier 44 held polymeric membrane 24 and support 22 in an inverted position ready for contact with a target substrate 50. An optical sensor or camera system 42 can optionally be used to view the target substrate through the polymeric membrane 24 and support 22, allowing automatic or manual guidance as the carrier 44 moves the shapes 34 in the direction of arrow 48 toward contact with sites on the target substrate. After temporary placement adjacent to the target substrate 50 so that the shapes 34 are permanently or temporarily held on the target substrate 50, the polymeric membrane 24 is separated by lifting or peeling away from the shapes 34 in the direction indicated by arrow 49 (as seen in FIG. 4)

The target substrate 50 represents a complex printed circuit board having various interconnected sensors, detectors, microelectronic devices, and apertures 53 for fluid flow. Alternative target substrates of greater or lesser complexity can of course also be used, including semiconductor wafer substrates, polycrystalline or amorphous substrates, flexible film substrates, ceramic substrates, metal substrates, or glass substrates. The target substrate 50 is fitted with fasteners 54 for temporarily or permanently holding shapes 34 in proper working position with respect to the substrate 50. These fasteners can be mechanical, adhesives such as epoxies or glues, solder bumps, or even thermoplastics that allow for reheating to loosen and reposition selected shapes 34 after attachment. Advantageously, such thermoplastics allow for fine tuning position, or replacement of malfunctioning elements, in large arrays of microelectronic or microelectromechanical devices.

Figure 5:
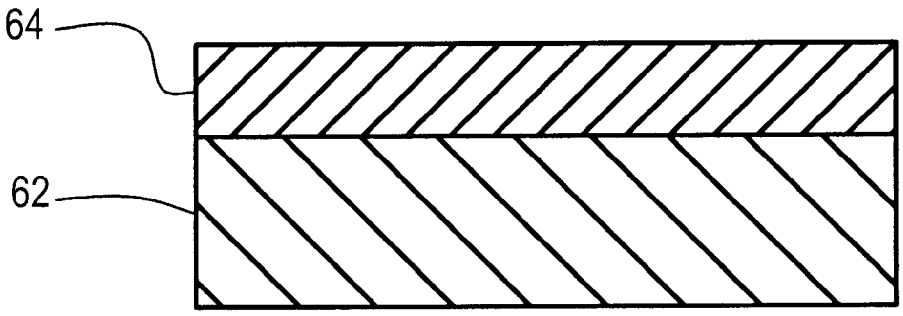
FIGS. 5–9 are schematic side views illustrating transfer of thin film structures from a source substrate to a target substrate by use of an intermediate substrate.
Figure 6:
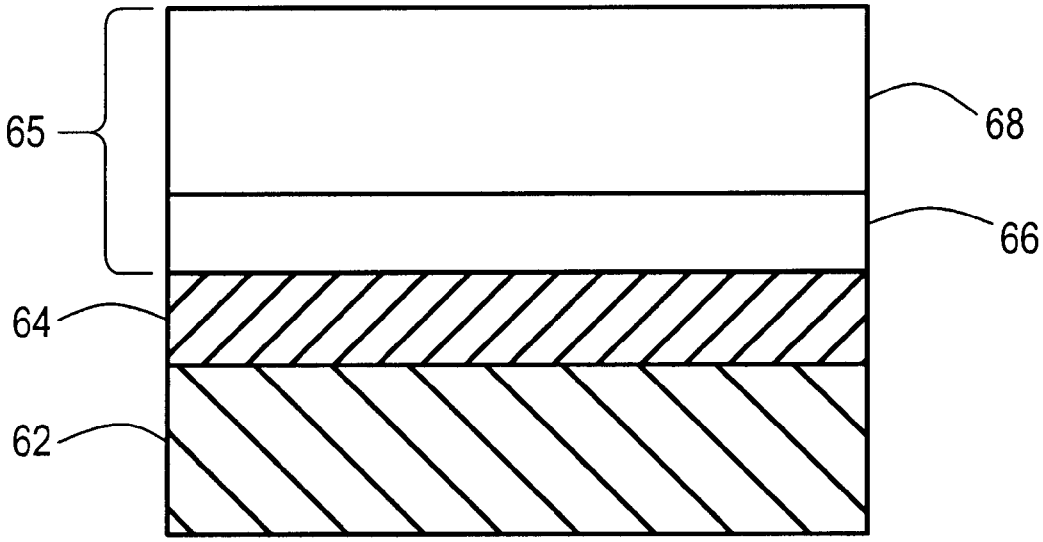
Figure 7:
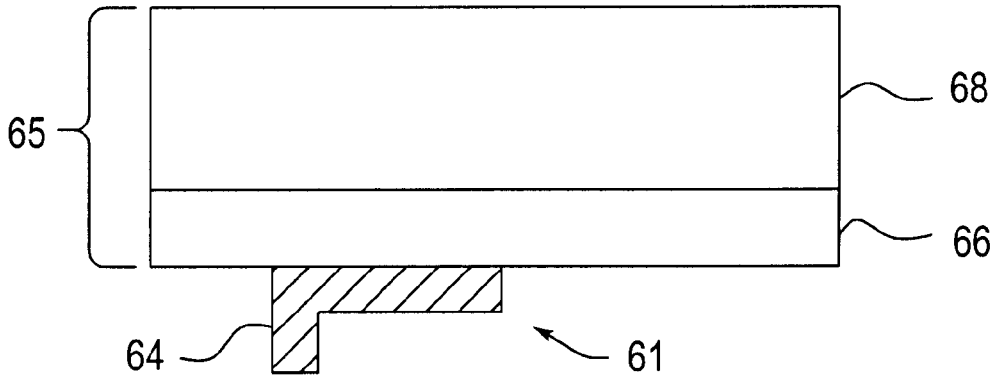
Figure 8:
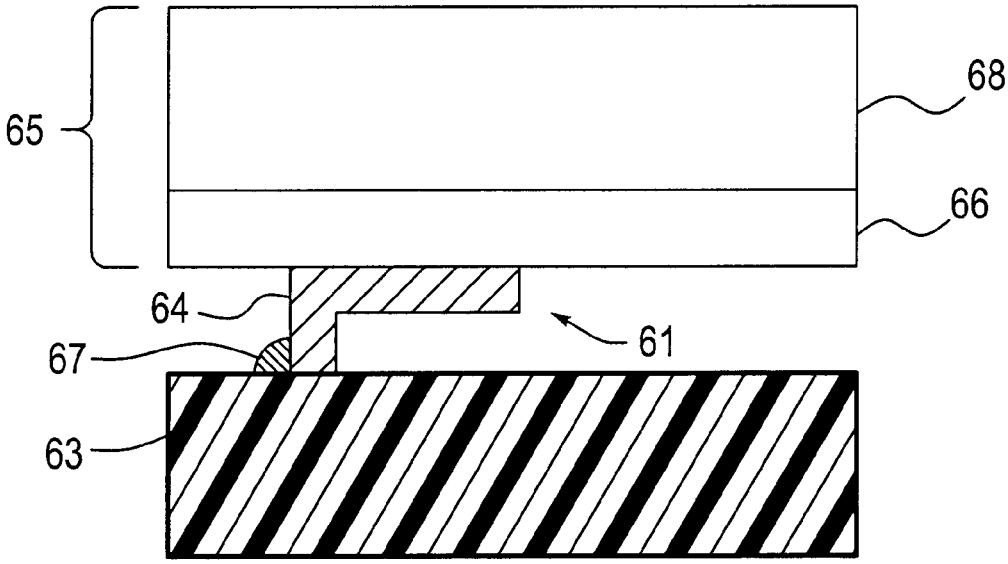
Figure 9:
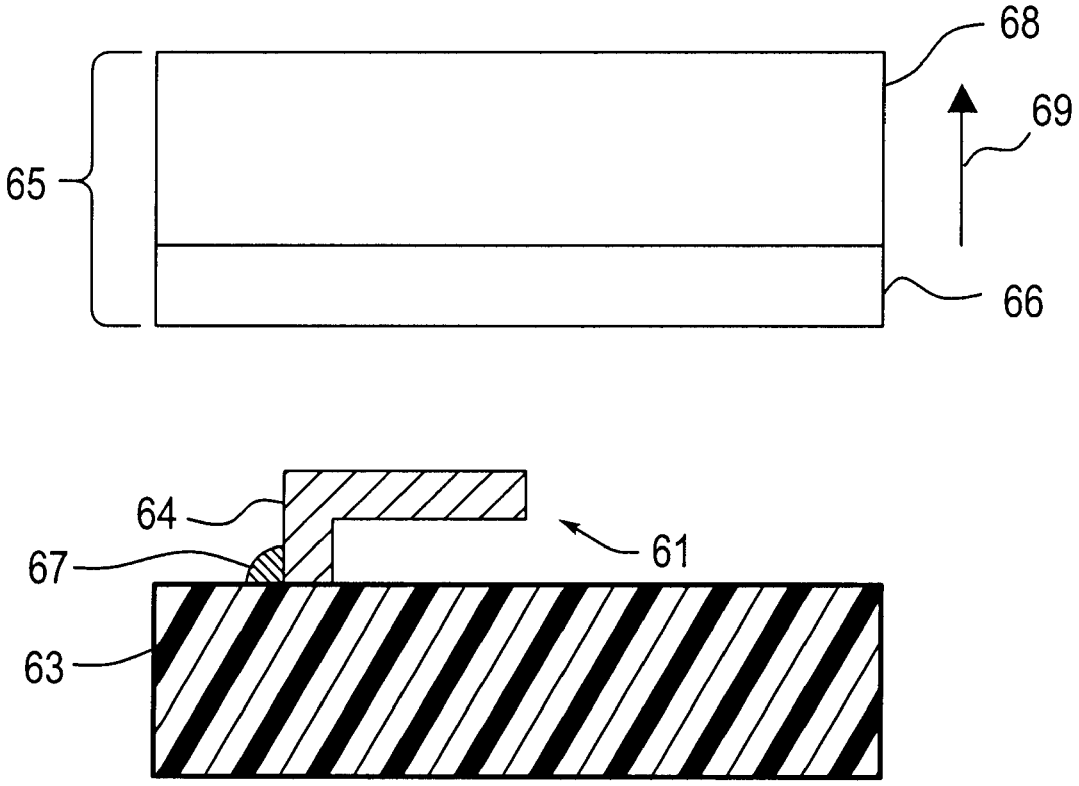

An alternative assembly process for creating thin film structures is illustrated with respect to FIGS. 5 through 9. As seen in FIG. 5, a thin film 64 is formed on an initial substrate 62 by any conventional growth or deposition process, including but not limited to epitaxial growth, spincoating, spraying, or laminating. As seen in FIG. 6, a thin film support 65 having a polymeric layer 66 and a support 68 (configured to be substantially similar in form and materials to support 25 of FIGS. 1–4) is brought into contact with the thin film 64. The initial substrate 62 can then be chemically etched away, ultrasonically separated, or otherwise removed from contact with the thin film 64. After separation, the thin film 64 can be etched, cut, ground, or machined to define a thin film structure (e.g. cantilevered element 61) as seen with respect to FIG. 7. This element 61 can attached by a bonding agent 67 to a target substrate 63, with the bonding agent 67 being any conventional solder, adhesive, thermoplastic, epoxy, potting compound, or permanent or temporary binding composition suitable for holding element 61 to substrate 63. In a final release step, the thin film support 65 is separated, pulled, or peeled away in direction 69 from contact with the thin film structure.

Figure 10:
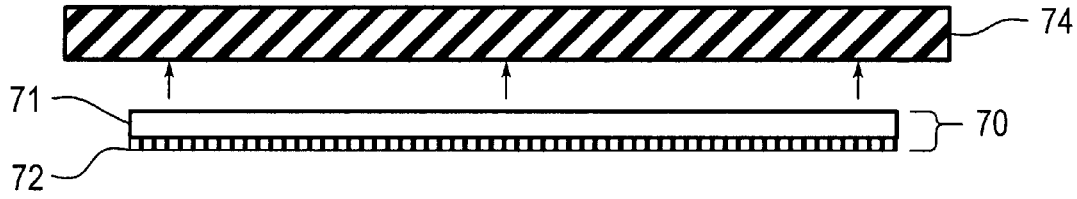
FIGS. 10–17 are schematic side views illustrating transfer of thin film structures from a source substrate to a target substrate using a sandwich of opposing polymeric membranes.

Another embodiment of the present invention is illustrated with respect to FIGS. 10 through 17. As seen in FIG. 10, a thin film 70 is composed of an aluminum layer 72 and a polyester layer 71. Usually, the polyester layer (sold under the tradename Mylar™) is a thin extruded film having a thickness of about 5 to about 20 microns, with about 12 microns being a typical thickness. The aluminum layer is very thin, typically having a thickness on the order on 0.1 microns.

As seen in FIG. 10, the thin film 70 is temporarily attached to a first membrane 74. Preferably, the first membrane 74 includes a low tack polymeric or elastomeric layer, and can be of single or multilayered. A suitable multilayered membrane is available from Vichem Corporation, Sunnyvale, Calif., under the trade name GEL-PAK™. Good results have been obtained by use of GEL-PAK part number BP-70-X0, which is a multilayered polyester/elastomer construction having an elastomeric layer about 150 microns thick; and a flexible polyester backing that is about 125 microns thick.

Figure 11:
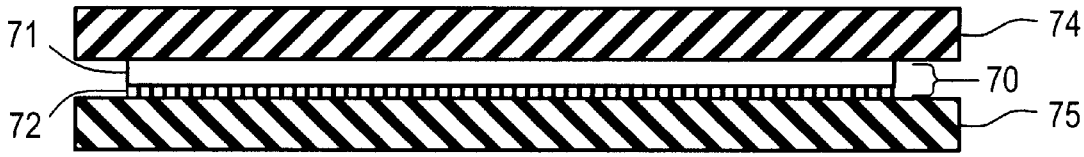

As seen in FIG. 11, a second membrane 75 can also be attached to thin film 70, sandwiching the thin film 70 between the first membrane 74 and the second membrane 75 therebetween. The second membrane 75 can be substantially identical in composition and attachment properties to first membrane, or in certain embodiments can have a slightly higher or slightly lower tack than the first membrane 74. A suitable membrane is GEL-PAK part DGL-70-X0, which has a slightly lower tack and retention than GEL-PAK part number BP-70-X0. As will be appreciated, a differential tack enhances retention of the thin film 70 (or any later defined thin film structures) on the higher retention membrane when the membranes 74 and 75 are peeled apart.

Figure 12:
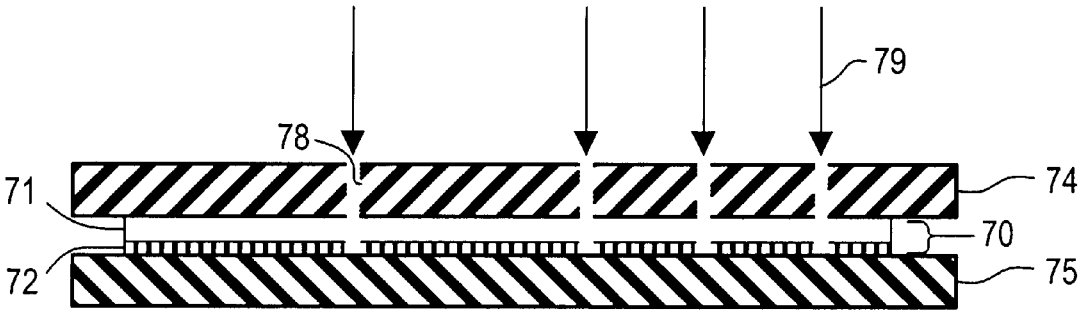

As illustrated in FIG. 12, the membrane sandwiched thin film 70 can be machined into various thin film structures by laser cutting beams 79. A conventional 50 watt infrared carbon dioxide laser operated at about 10 watts with a 200 micron beam diameter can be used. During laser cutting, the membrane 74 and thin film 70 is ablatively heated and evaporated to leave cuts 78. Use of a carbon dioxide laser is advantageous because polyester material is able to absorb the infrared spectrum of carbon dioxide laser, despite some reflections from aluminum layer 72. The applied power is precisely controlled to ensure that only membrane 74 is cut, with membrane 75 being substantially uncut.

Figure 13:
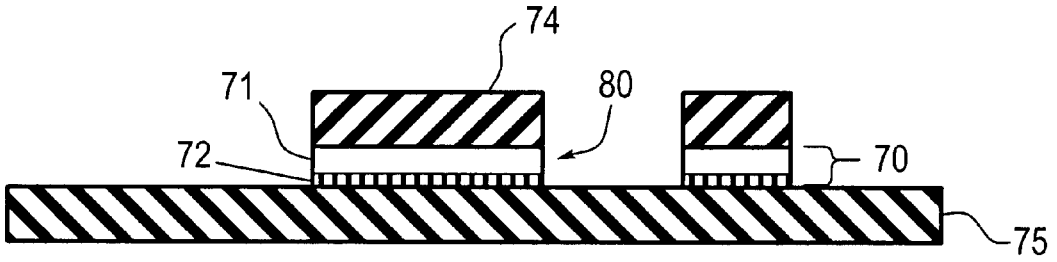
Figure 14:
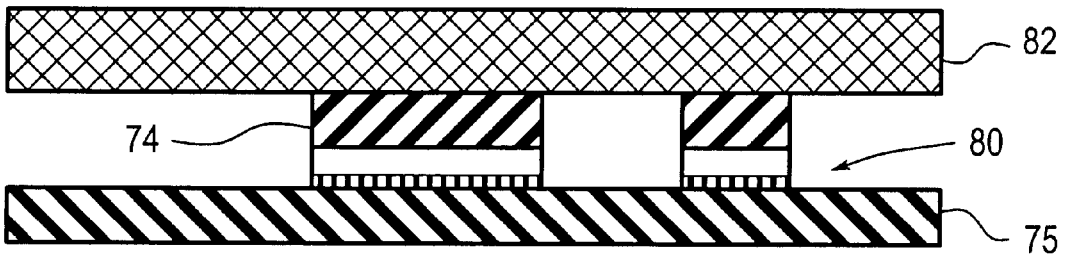

As seen in FIG. 13, unwanted portions of membrane 74 and thin film 70 are manually peeled and removed, leaving thin film structures 80 sandwiched between the membrane 75 and the overlaying remnants of membrane 74. This process is facilitated by ensuring that the unwanted portions are mostly connected together after cutting, permitting a one or two step continuous peeling operation. In FIG. 14, the thin film structure transfer process proceeds by attachment of an adhesive film 82 (which typically includes an adhesive on a sheet of polyester carrier) to the remnants of membrane 74 to keep isolated parts together. The retention properties or tackiness of this adhesive has to be much stronger than that of membrane 74. One suitable adhesive is manufactured by 3M Corporation as Scotch 467MP Hi performance adhesive.

Figure 15:
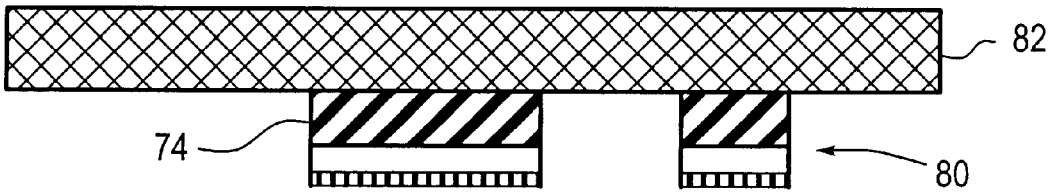
Figure 16:
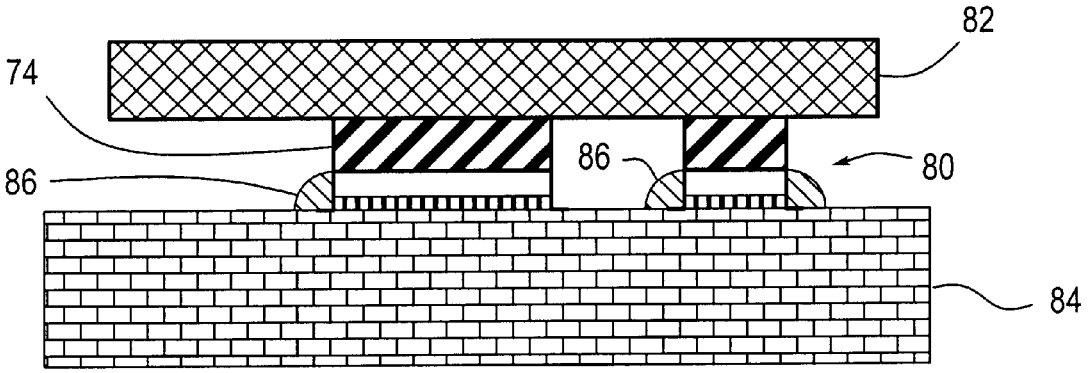

FIG. 15 illustrates separation of the membrane 75 from the thin film structures 80. Advantageously, separating membrane 75 from the aluminized surface also removes any particles or laser cut debris that would have fallen onto the aluminized surface of polyester, readying the thin film structures 80 for attachment to a target substrate 84 (e.g. a printed circuit board or other suitable substrate) as seen in FIG. 16. This is particularly useful since mechanical and laser cutting processes operate in relatively dirty environments. Besides the usual assortment of particulates, dust, organic, and inorganic residue, the ablated or ground or cut material falling back down onto the thin film represents a serious quality control issue. Most contamination is removed by contact or non-contact methods. If the thin film structures are too sensitive for any post handling or the contamination is unremovable, as in the case of ablated material (laser beam processing of different materials with very different melting temperatures), post clean-up is not even an option. The foregoing solution prevents contaminating particles from coming to rest on the thin film structures 80. By sandwich lamination of a membrane over the thin film, a disposable barrier is created which prevents any debris, dust or particulates from falling onto the thin film structures.

Figure 17:
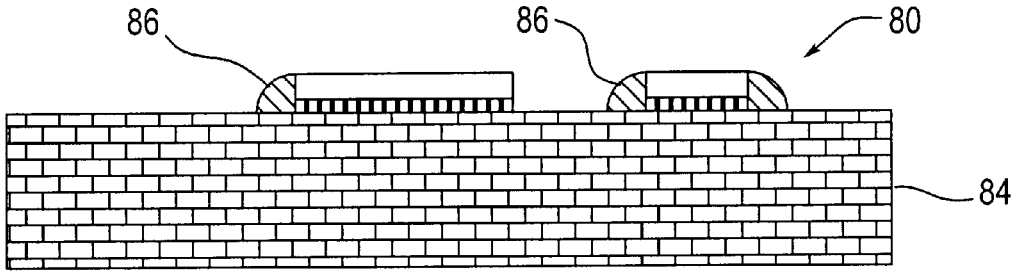

In a final step, the thin film structures 80 are adhesively attached by pre-applied bonding agents 86, and the adhesive film 82 with attached membrane 74 is pulled away to leave the thin film structures 80 properly positioned on the substrate 84 as seen in FIG. 17.

Advantageously, the foregoing process provides a flexible way to quickly prototype and batch produce 2-dimensional thin film structures for microelectromechanical applications. For example, the present process allows for efficient production of cantilevered electrostatically operated air valve flap arrays on a printed circuit board substrate. In one embodiment (schematically illustrated with respect to FIG. 4), a printed circuit board can be prepared with smooth electrodes and dielectric coating before transfer of thin film laser cut flaps. The flaps can be laser cut from roll form aluminized polyester film, with the patterned polyester film ready to transfer onto a printed circuit board with the aluminized side facing board for subsequent electrostatic interactions.

As will be seen in connection with FIGS. 18 through 26, use of the method of the present invention prevents heated polyester materials from protruding (commonly known as edge beading). Edge beading is particularly undesirable in microelectromechanical applications, since these unwanted protrusions increase the air gap between the aluminized surface and an electrode on the printed circuit board, reducing the electrostatic attraction forces relative to smooth flap edges.

Figure 18:
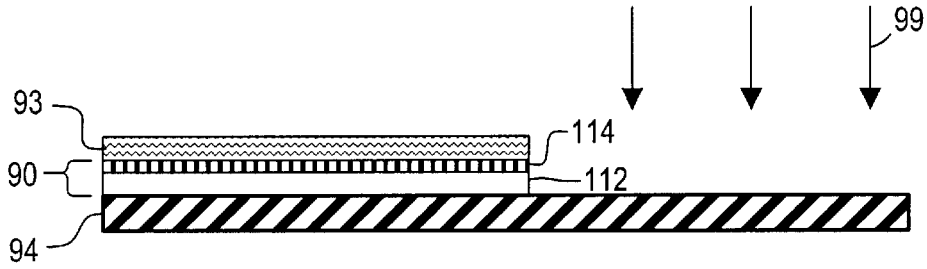
FIG. 18 illustrates laser cutting of a metallized thin film unconstrained by a sandwich layer of opposing polymeric layers.
Figure 19:
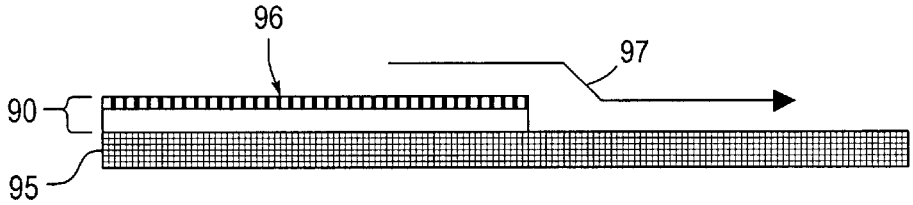
FIG. 19 illustrates measurement of a surface profile of the cut metallized thin film of FIG. 18.
Figure 20:
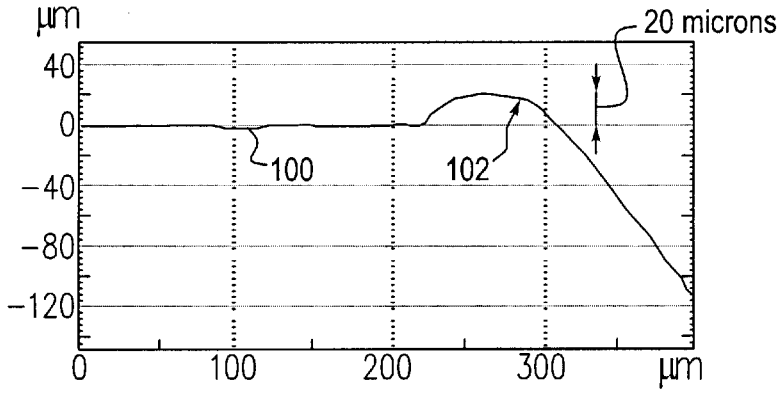
FIG. 20 is a graph showing the surface profile of the cut thin film of FIGS. 18 and 19.

Undesired edge beading is illustrated with respect FIGS. 18 through 20. As seen in FIG. 18, a thin film 90 (including an aluminum layer 114 and polyester layer 112) is laminated onto a membrane 94. A 5 micron layer of water soluble film 93, sold under the tradename of Ambermask™ by Innovative Organics Inc., is spin coated onto the aluminum layer 114 to prevent debris from falling and attaching onto the surface. A laser cut is executed, in direction 99 and the unused portions of polyester layer 112 removed. As seen in FIG. 19, the film 93 is rinsed off and the thin film 90 is transferred to measurement substrate 95. The thin film is then measured by gliding a stylus of a profilometer 96 in direction 97 across thin film 90 and measurement substrate 95. As seen in FIG. 20, which is a graph of the resultant profilometer plot 100, serious edge beading 102 results from this process, with twenty microns of thin film 90 protruding beyond surface level. As will be appreciated, such edge beading can drastically reduce the effectiveness of electrostatic interaction of this film to a smooth dielectric.

Figure 21:
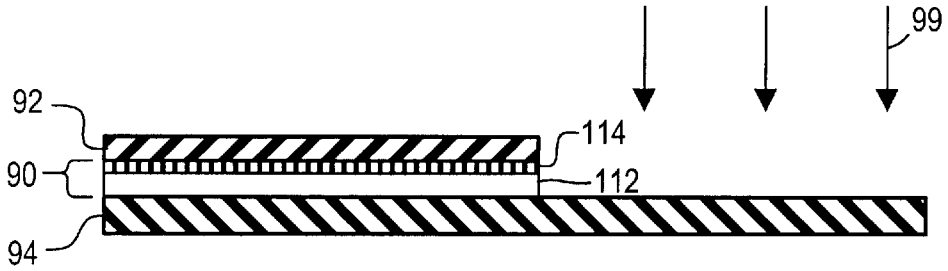
FIG. 21 illustrates laser cutting of thin films substantially identical to that shown FIG. 18, with the thin films constrained by a sandwich layer of opposing polymeric layers.
Figure 22:
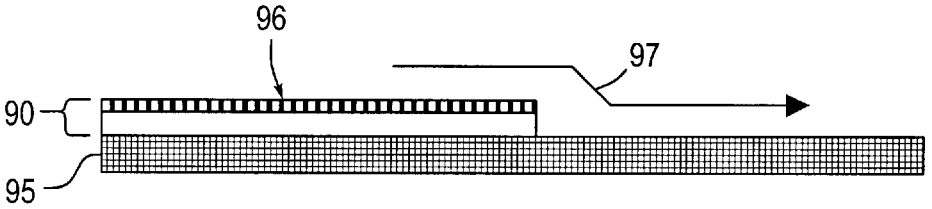
FIG. 22 illustrates measurement of a surface profile of the cut thin film of FIG. 21.
Figure 23:
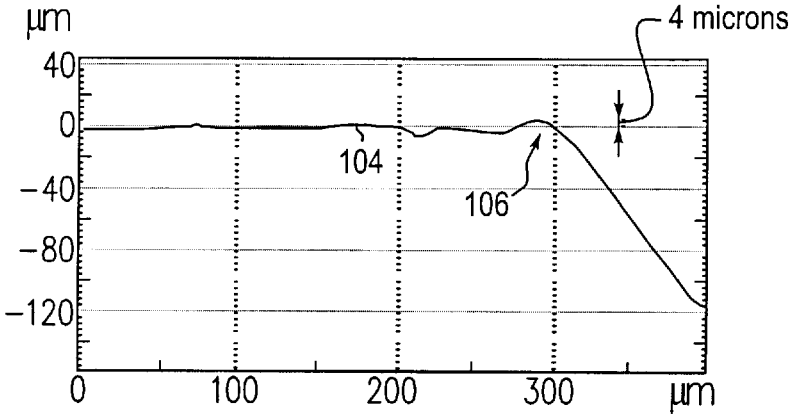
FIG. 23 is a graph showing the surface profile of the cut thin film of FIGS. 21 and 22.

In contrast, FIGS. 21 through 23 illustrate sandwiching a thin film layer between elastomeric membranes 92 and 94 (respectively GEL-PAK part DGL-70-X0, which has a slightly lower tack and retention than GEL-PAK part number BP-70-X0). A laser cut is executed, in direction 99 and the unused portions of polyester layer 112 removed. As seen in FIG. 22, the thin film 90 is transferred to measurement substrate 95 and measured by gliding a stylus of a profilometer 96 in direction 97 across thin film 90 and measurement substrate 95. As seen in FIG. 23, which is a graph of the resultant profilometer plot 104, edge beading 106 is greatly reduced, with only four microns of thin film 90 protruding beyond surface level.

Figure 24:
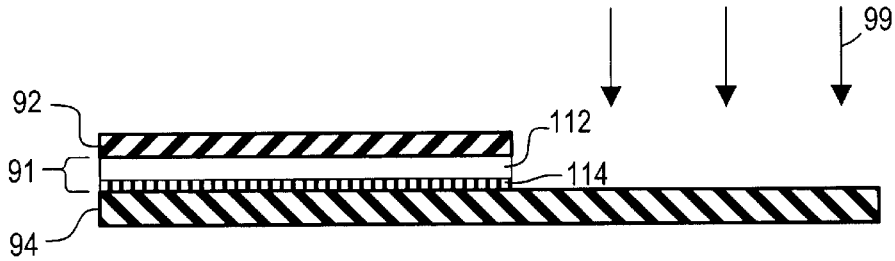
FIG. 24 illustrates laser cutting of thin films substantially identical to that shown FIG. 21, except with the orientation of the metallized layer with respect to the laser cutting reversed, with the thin films constrained by a sandwich layer of opposing polymeric layers.
Figure 25:
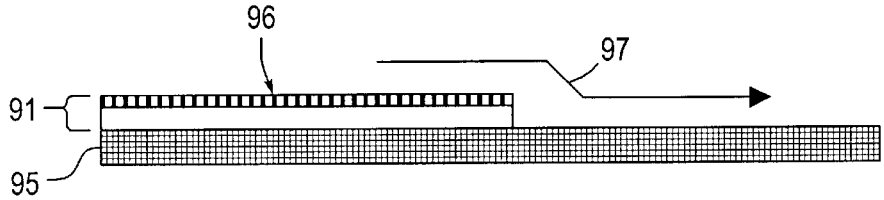
FIG. 25 illustrates measurement of a surface profile of the cut thin film of FIG. 24.
Figure 26:
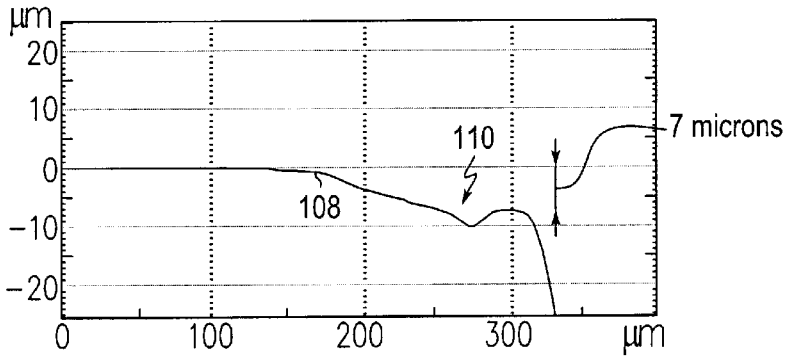
FIG. 26 is a graph showing the surface profile of the cut thin film of FIGS. 24 and 25.

Edge beading can be reduced even more by inversion of the thin film layer as seen with respect to FIGS. 24 through 25. Again the thin film layer 90 is sandwiched between elastomeric membranes 92 and 94, a laser cut is executed, in direction 99 and the unused portions of polyester layer 112 removed. As seen in FIG. 25, the thin film 90 is transferred to measurement substrate 95 and measured by gliding a stylus of a profilometer 96 in direction 97 across thin film 90 and measurement substrate 95. As seen in FIG. 26, which is a graph of the resultant profilometer plot 108, edge beading 110 is substantially eliminated.

As those skilled in the art will appreciate, while elastomeric membranes have certain advantages, they are not required for practice of the present invention. Alternatively, a chemically or plasma etchable material such as dry film photoresist can be used for sandwiching layers. Materials susceptible to radiation induced breakdown, or various solvent soluble dry films, can also be used. Such materials allow, for example, sandwiching a thin film with one or more dry film photoresist layers, cutting or machining a thin film to form various thin film structures, etching away at least one photoresist layer, and transfer of the thin film structures with elastomeric membranes in accordance with the present invention.

Figure 27:
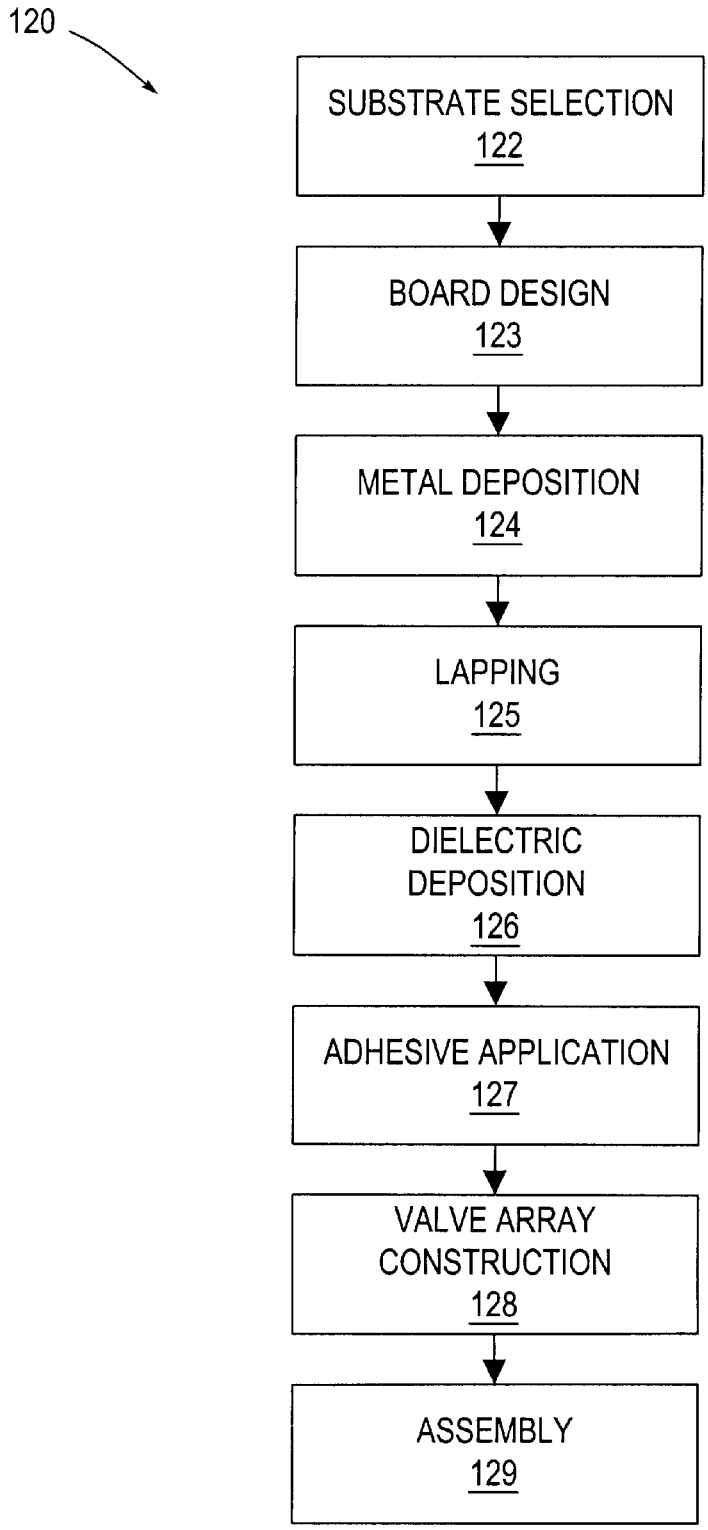
FIG. 27 is a schematic diagram illustrating various processing steps useful for batch process construction of thin film structures on various substrates.

As seen with respect to FIG. 27, a wide variety of techniques and materials can be used in conjunction with the present invention to define, construct and assemble microelectromechanical assemblies. For example, batch fabrication 120 of electrostatic air valves can proceed by selection 122 of a suitable substrate. Preferred materials include FR4 (epoxy/glass laminate) or RO4003 (epoxy/ceramic laminate). Possible substrates include flexible polymeric substrates, glass substrates, or ceramic substrates. The substrates can be prepared by drilling, cutting or machining to define a desired form factor. Apertures varying in diameter between about 0.5 and 5 millimeters can be defined or drilled into the substrate to serve as valve ready fluid channels.

Board design 123 can include selection of materials and layout of circuit design. Suitable materials include double sided electrodeposited copper cladding and standard electroless plating (gold/nickel/copper). For best results, the circuit design maximizes area for screen printing adhesive features while minimizing risk of shorting traces during adhesive reflow. Typically, designs utilize standard subtractive methods (e.g. unwanted copper is selectively removed by etching).

Suitable board design methodologies include deep well techniques, shallow well techniques, and planar techniques. Deep well include designs having a well height of approximately 0.002 inches. Deep well techniques advantageously allow simple one-layer printed circuit board designs that confine reflow of conductive adhesive and facilitate use of standard minimum thickness (0.004") of screen-printed conductive thick films.

Alternatively, shallow well techniques having a well height of approximately 0.0004" can be used. Shallow well techniques eliminate the need for a hard stop in oxygen plasma etch process, confines reflow of conductive adhesive, and enables build-up layers with existing processes (as in IC fabrication). In addition, in shallow well techniques the adhesive alignment to substrate traces is not as critical, the amount of adhesive is not critical to establishing continuity, and electrical contact is assured through metallization at the bottom of the shallow well.

For certain embodiments, planar well techniques can be employed. Planar well design permits simple one layer PCB design, and like shallow well techniques, eliminates the need for a hard stop in oxygen plasma etch process. Advantageously, in such embodiments the amount of adhesive is not critical to establishing electrical continuity, since electrical contact is assured through zero-bondline between flexible and rigid substrate.

Metal deposition 124 can include deposition of chrome (100–300 Å), gold (500–1500 Å), or any other suitable metal, generally by evaporative physical vapor deposition through a suitable shadow mask. While not required for deep well designs, metal deposition does provide a hard etch stop for the oxygen plasma and a path of continuity between the printed circuit board trace, adhesive and microelectromechanical valve flaps.

Lapping 125 uses a slurry of 2 micron diamond in colloidal silica (0.1 micron) in an ethylene glycol/water solution. A polishing pad (Hyprez S4) is used in a chemical-mechanical polishing (CMP) process to smooth the substrate and introduce a smoother surface texture. For example, 120 pounds of lapping pressure can be applied to the substrate at 36 rpm for approximately 1–6 minutes. After rinsing (in house water) and drying, at least localized improvements in surface roughness are found.

Dielectric deposition 126 of parylene C (5 microns thick) or other suitable dielectric is possible after lapping step 125. A conformal dielectric coating can be applied onto both sides of the substrate by chemical vapor deposition, followed by selective removal of the dielectric via oxygen plasma etching. Vias on the active side of the substrate are defined by the aperture (shadow) mask. Advantageously, dielectric deposition 126 provides a dielectric insulating material between electrodes on the substrate and any metallized flexible flaps that are later to be applied. In addition, a dielectric coating can enhance moisture and chemical barrier properties of the finished assembly.

Adhesive application 127 to the substrate may utilize electrically conductive thermoset epoxy (silver loaded; $T_{reflow}$ 125–150° C.) or electrically conductive thermoplastic adhesive (silver loaded; $T_{reflow}$ 80–90° C.). Both types of adhesives are screen-printed onto defined areas of the substrate (with a thickness dependent on board design, ranging from 0.001" to 0.004"). Thermoplastic material is reworkable (reuseable) in the advent of misalignment during assembly, and can be used to hold a wide range of thin film structures, including microelectronic and microelectromechanical elements.

Valve array construction 128 for assembly onto the substrate can proceed in accordance with the present invention by use of low retention polymer membranes as previously discussed. Thin films in sheet or roll form can be sandwiched between polymeric membranes and mechanically (die cut, drill, punch) or optically (laser) cut. The formed thin film structures are ready for attachment to the substrate.

Assembly 129 typically requires reheating the substrate to soften thermoset or thermoplastic adhesive; peeling off the free standing protective polymeric membrane layer; flipping and aligning the polymeric membrane flexible sheet of thin film structures with respect to defined features on the substrate; and tacking and bonding the array of thin film forms onto the rigid substrate, with the thermoplastic adhesive establishing a bond as it cools from 80 to 90 degrees Celsius to room temperature, and the thermoset bond requiring application of higher temperatures and use of some applied pressure. The final step involves peeling off the final layer of membrane to leave the thin film structures properly attached in correct relationship to the substrate.

As those skilled in the art will appreciate, other various modifications, extensions, and changes to the foregoing disclosed embodiments of the present invention are contemplated to be within the scope and spirit of the invention as defined in the following claims.

What is claimed is:

1. A method for fabrication of thin film structures, comprising:

sandwiching a thin film between a first layer and a substantially rigid second layer, wherein the second layer is a polymeric membrane comprising a support layer and an elastomeric layer, with the elastomeric layer affixable to the thin film;

machining the thin film and the first layer to define a thin film structure;

separating the first layer and an unneeded portion of the thin film from the defined thin film structure and the second layer; and attaching the thin film structure on the substantially rigid second layer to a target substrate.

2. The method of claim 1, wherein the machining step is at least one of optically cutting the thin film with a infrared, optical or ultraviolet laser, stamp cutting, shearing, punching, blanking, polishing, hammering, coining, flanging, and high pressure fluid cutting.

3. The method of claim 1 wherein the second layer is substantially transparent.

4. The method of claim 1, wherein the separating step is at least one of mechanically peeling, lifting, washing and chemically etching the first layer from the defined thin film structure.

5. The method of claim 1, wherein the first layer and the elastomeric layer of the second layer have different tack to the thin film.

6. The method of claim 1, wherein at least one of the first layer and the elastomeric layer of the second layer is at least one of a cross linked polymeric membrane, a gel polymeric membrane, a polysiloxane, a polyurethane, a styrene, an olefinic, a copolyester, a polyamide, an elastomer and a melt processible rubber.

7. A method for batch fabrication of thin film structures, the method comprising the steps of sandwiching a thin film between first and second polymeric membranes machining the thin film to define an array of structures having a positive ground and a negative ground, peeling away the first polymeric membrane, separating one of the positive ground and the negative ground array of structures from the second polymeric membrane, applying an adhesive to selected areas of the target substrate, attaching the array of structures affixed to the second polymeric membrane to a target substrate after the step of applying an adhesive.

8. The method of claim 7, wherein second polymeric membrane is substantially transparent.

9. The method of claim 8, further comprising the step of optically aligning the array of structures affixed to the substantially transparent second polymeric membrane with the target substrate.

10. The method of claim 7, wherein the second polymeric membrane is an elastomer.

11. The method of claim 7, wherein the second polymeric membrane is a polysiloxane.

12. The method of claim 7, wherein the adhesive is a thermoplastic.

* * * * *